United States Patent [19]

Dry

[11] 3,951,051

[45] Apr. 20, 1976

[54] DAMPERS

[75] Inventor: Hal Dry, Winters, Tex.

[73] Assignee: Wallace-Murray Corporation, New York, N.Y.

[22] Filed: July 2, 1974

[21] Appl. No.: 485,122

[52] U.S. Cl. ..... 98/42 R; 49/376; 98/85; 98/115 R; 126/285 B; 137/601; 251/303

[51] Int. Cl.[2] ..... F24F 7/06; F24F 13/10

[58] Field of Search ..... 126/285, 287.5; 98/85, 98/86, 115 R, 116, 42, 32; 137/601; 251/303; 49/379

[56] References Cited

UNITED STATES PATENTS

| | | | |
|---|---|---|---|
| 1,828,016 | 10/1931 | Andres | 98/116 |
| 1,949,133 | 2/1934 | Smith | 49/379 |
| 2,120,060 | 6/1938 | Williams | 98/85 |
| 2,725,003 | 11/1955 | Lyons | 98/86 |
| 2,827,003 | 3/1958 | Stetson | 98/86 |
| 2,837,991 | 6/1958 | DeRoo | 98/85 |
| 3,611,909 | 10/1971 | Gaylord | 98/115 K |
| 3,616,745 | 11/1971 | Russell, Sr. | 98/115 R |
| 3,665,958 | 5/1972 | Dunkelis | 251/303 |
| 3,830,016 | 8/1974 | Levine | 98/86 |

*Primary Examiner*—William F. O'Dea
*Assistant Examiner*—Ronald C. Capossela
*Attorney, Agent, or Firm*—Carl B. Fox, Jr.

[57] ABSTRACT

Dampers operable by energization of an electrical circuit or by deenergization thereof to open or close, for control of smoke ventilation in case of a fire. The dampers are held closed, or open, either by a magnet or by a spring. The dampers may be used in ventilation systems of any other type.

18 Claims, 7 Drawing Figures

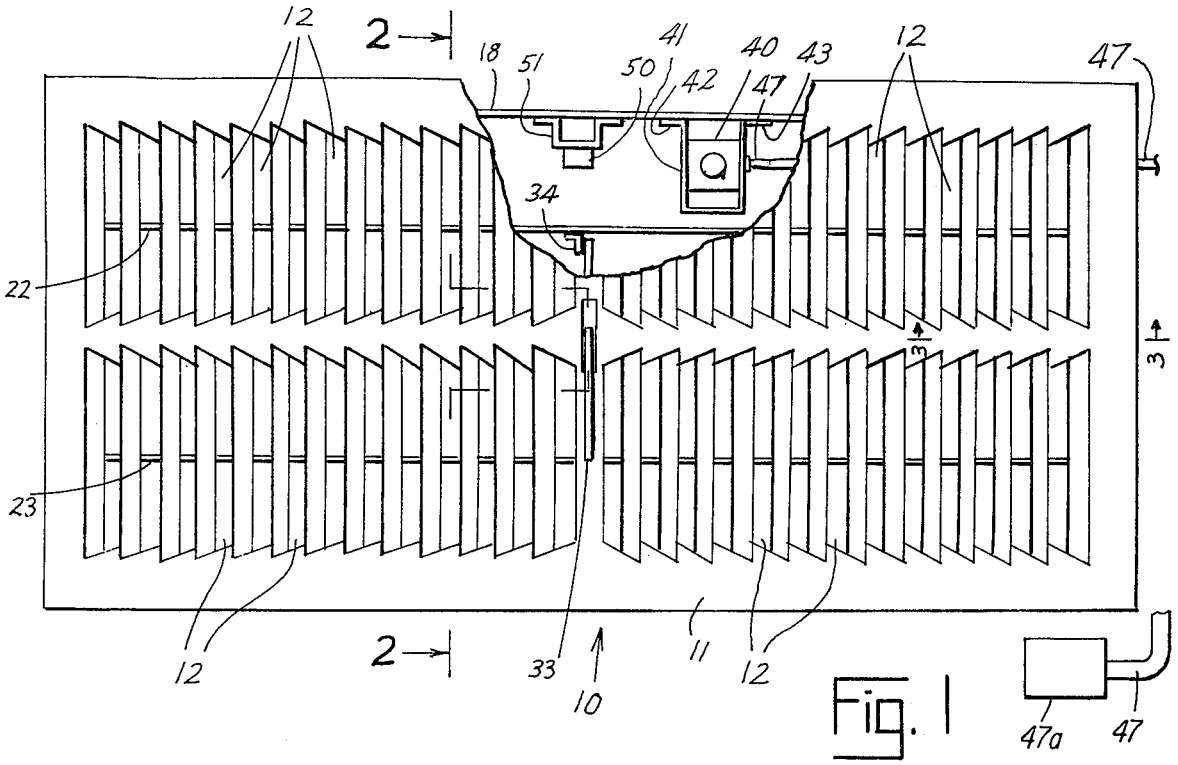
Fig. 1
Fig. 2
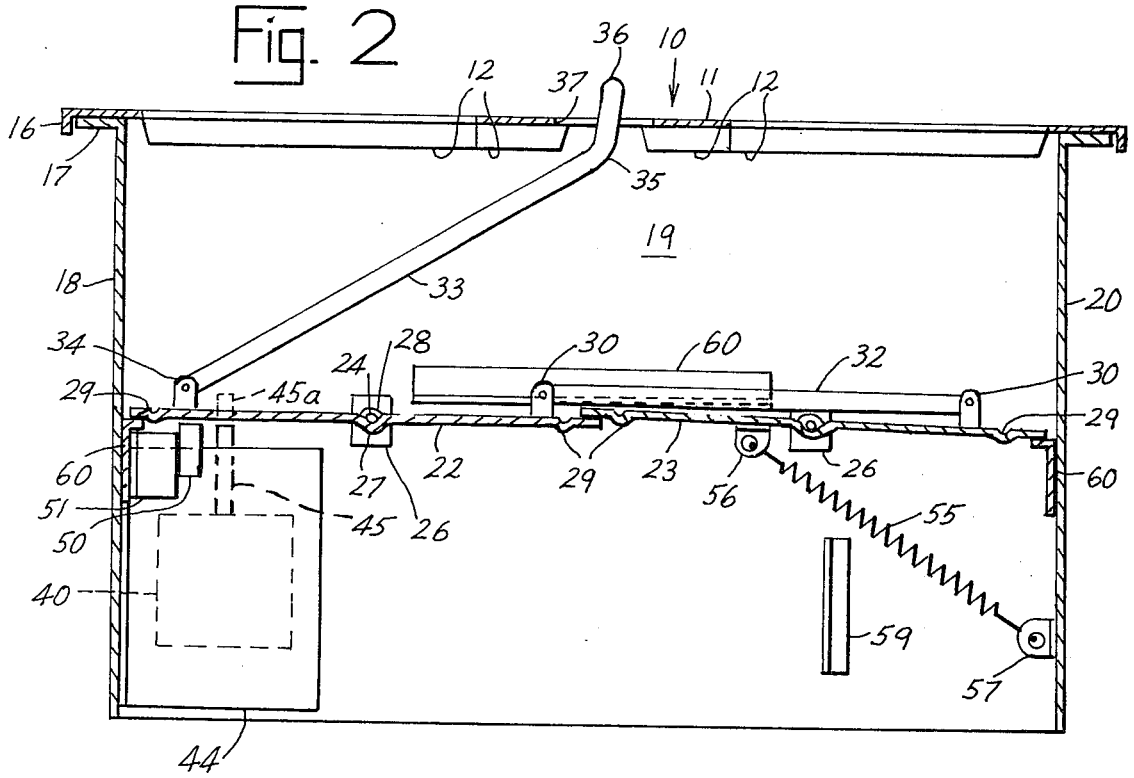

Fig. 3
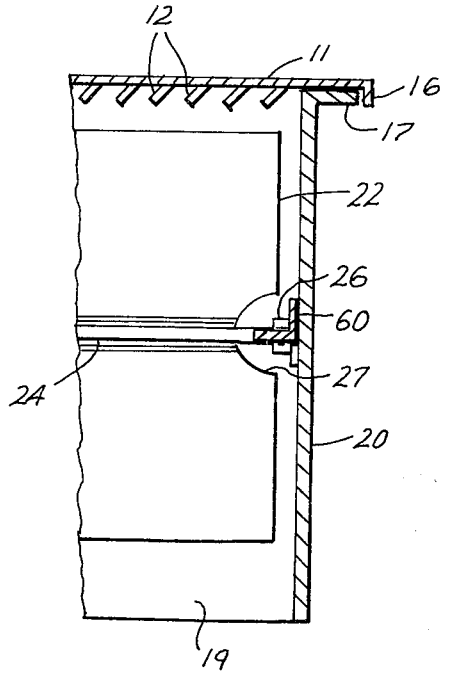
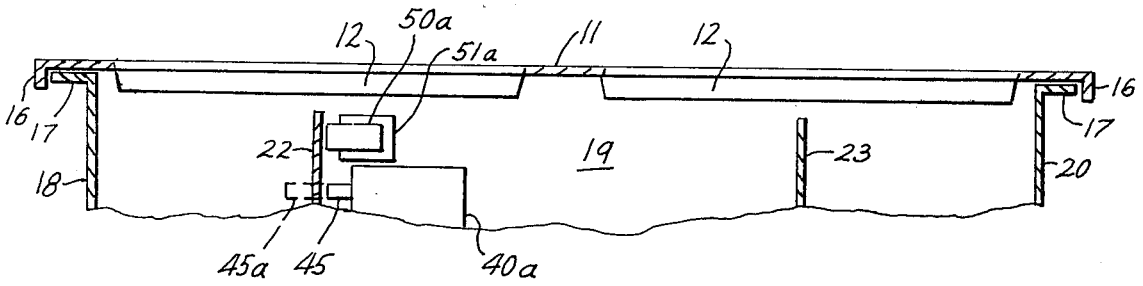
Fig. 4

DAMPERS

SUMMARY OF THE INVENTION

The invention provides automatic dampers which are automatically closed or opened to seal off or to ventilate an area in case of fire, to either prevent ingress of smoke or to provide an outlet for smoke. The dampers may be held closed by a magnet or a spring, and opened upon energization of a circuit, or may be held open by a magnet or a spring, and closed upon energization of the circuit. The devices may also be operated by deenergization of the circuit.

When fires occur, it is frequently desirable that certain building areas be either isolated from the smoke or provided with one or more openings so that smoke may flow therefrom. These measures are necessary in order to protect human life, and sometimes to protect equipment and installations within buildings. In particular, in many areas it is necessary in compliance with fire codes that stair wells, elevator shafts, and the like, be ventilated to permit smoke to flow therefrom in the case of a fire. The ventilators which are normally maintained closed are automatically opened in the event of fire by operation of a switch in some remote part of the building or by functioning of a smoke, fire or heat detection device.

The dampers provided according to the invention are dependable in operation yet are relatively simple in design and economical. The dampers are capable of meeting fire codes and regulations in substantially all areas where such apply.

The principal object of the invention is to provide damper apparatus for smoke control. An additional object of the invention is to provide such smoke control dampers which are reliable and dependable, yet are economical in cost. Still another object of the invention is to provide dampers which may be normally held either closed or open, and which may be operated either automatically in response to a signal from a detection apparatus, or may be operated by hand operation of a switch device.

Other objects and advantages of the invention will appear from the following detailed description of preferred embodiments, reference being made to the accompanying drawings.

BRIEF DESCRIPTIONS OF THE DRAWINGS

FIG. 1 is a front elevation, partly in cross section, showing a ventilator of preferred form according to the invention.

FIG. 2 is an enlarged cross section taken at line 2—2 of FIG. 1.

FIG. 3 is a partial cross section taken at line 3—3 of FIG. 1.

FIG. 4 is a partial cross section showing a modified form of apparatus according to the invention.

Figure 5:
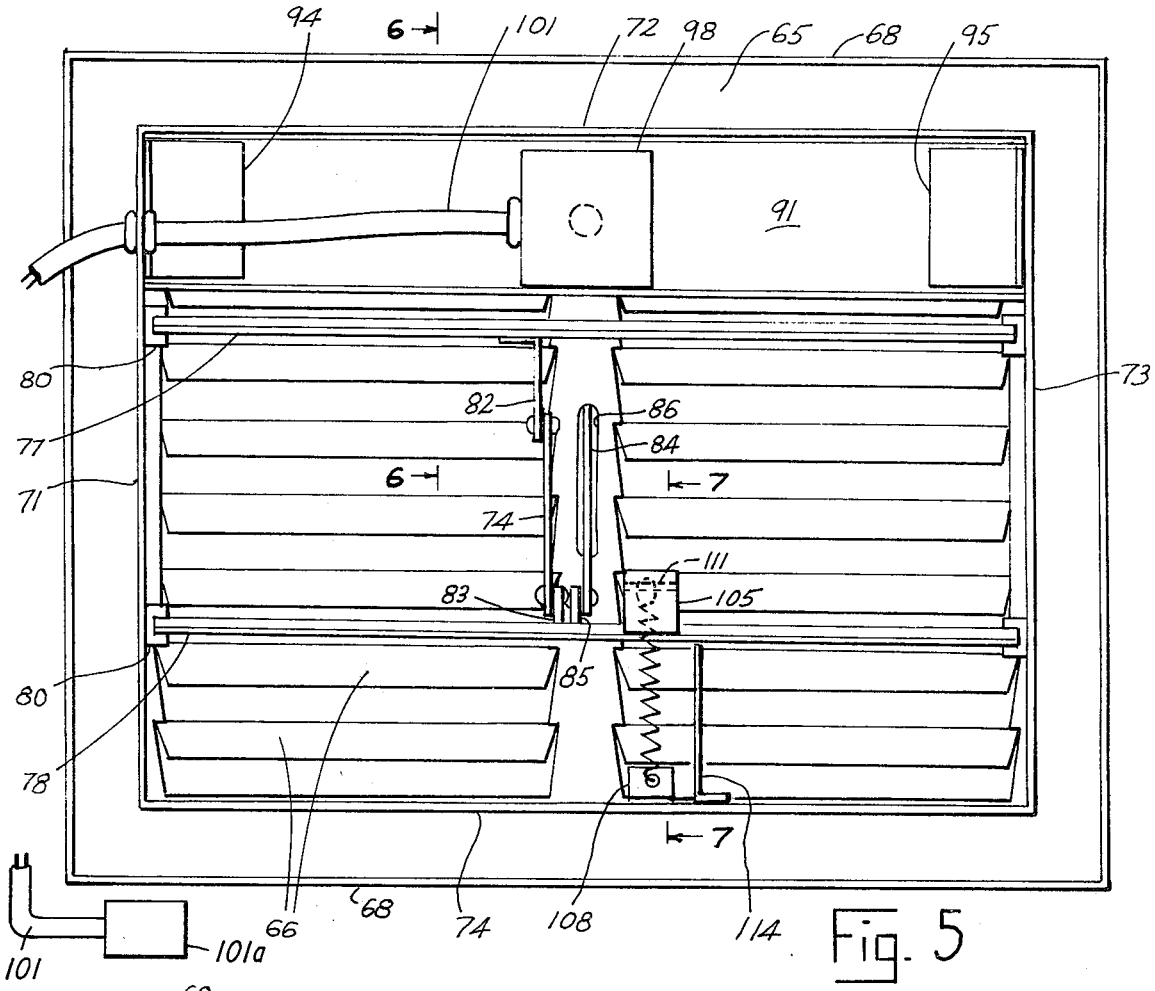
FIG. 5 is a rear elevation of a further modified form of apparatus according to the invention.
Figure 6:
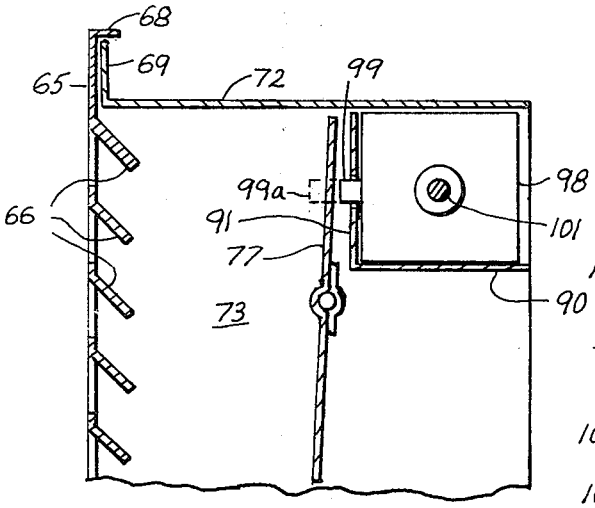
Figure 7:
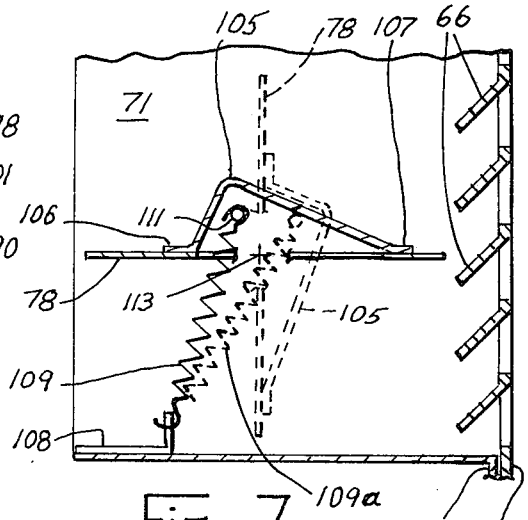

FIGS. 6 and 7 are partial cross sections taken at line 6—6 and 7—7 of FIG. 5, respectively.

DESCRIPTIONS OF THE PREFERRED EMBODIMENTS

Describing the preferred embodiments in detail, and referring first to FIGS. 1–3 of the drawings, the damper apparatus 10 includes a front or cover 11 having plural symetrically arranged slatted louvers 12 therethrough.

Cover 11 has inturned flange or skirt 16 therearound which covers the edge of outturned flange 17 of housing walls 18, 19, and 20, and a fourth wall provided opposite wall 19 and not shown in the drawings. The flange 17 extends completely around the housing and is fastened to cover 11 by plural fasteners, not shown. The housing made up of walls 18–20 and the described fourth wall is normally mounted into a wall or ceiling in well known manner. The cover 11 is disposed flatly against the ceiling or wall around an opening which receives the housing to provide an attractive appearance for the apparatus.

A pair of damper vanes 22, 23 are each pivotally movable simultaneously between open and closed positions with regard to air or gas flow through the louvers and housing. Each damper 22, 23 is carried on a rod 24 which is fixed at each end in a socket or bracket 26, permitting pivotal rotation of the damper vanes.

The vanes have semicircular cutouts 27 to provide space for the end mountings of rods 24. The vanes are semicircularly upset at 27 to accommodate the rods 24, and semicircular laps 28 suitably connected to the vanes hold the rods securely in place. The vanes are semicircularly upset at 29 to stiffen the vanes.

A bracket 30 is affixed to the inner upper side of vane 22 in the closed position of FIG. 2 and a similar bracket 30 is affixed to the right hand upper surface of vane 23 in said closed position. Bar 32 is pivotally connected to brackets 30, 30 to extend therebetween. A bar 33 forming an operating lever is pivotally connected to a bracket 34 affixed to the upper left hand surface of vane 22 in said closed position. Bar 33 is curved at 35 near its end 36 and extends through a slot 37 through cover 11. When end 36 of bar 33 is pulled outwardly of the slot, the vanes are simultaneously moved to open positions. When bar 33 is pushed inwardly of slot 37 the two dampers are simultaneously moved to the inclosed positions of FIG. 2. Damper 23 is moved by bar 32 in response to movement of vane 22.

A solenoid actuator 40 is carried within a U-shaped bracket 41 suitably secured at flanges 42, 43 to wall 18 of the housing. Bracket 41 may be secured to wall 18 by screws, by welding, or in any other suitable manner. Solenoid actuator 40 has axially movable shaft or rod 45 which is extended and retracted electrically, by energization or deenergization of the solenoid actuator through cable 47 which is converted to a suitable electrical source. Cable 47 may be connected to a sensor or detector which will supply or cut off current in response to detection of smoke, heat, or fire. The current through cable 47 may alternately be controlled by a manually operated switch located at a remote location.

A magnet 50 is carried by U-shaped bracket 51 suitably secured to wall 18 by screws, welds, or in other suitable manner. When damper vanes 22, 23 are closed, as in FIG. 2, vane 22 is attracted by magnet 50 to remain in closed position. when the vanes are to be opened, actuator 40 is suitably energized or deenergized to cause extension of rod 45 to position **45*a*. The rod movement to position 45*a* moves the left hand portion, FIG. 2, of vane 22 farther from magnet 50 so that the vane is drawn less by the magnet and is opened by a tension spring 55. Spring 55 is a helical tension spring connected between brackets 56, 57 which are suitably affixed to the underside of the left hand portion of vane 23 and to wall 20, as shown. When the pull of magnet 50 is no longer effective to hold vane 22 closed, spring 55 draws the left hand part, FIG. 2, of vane 23 toward angle stop 59 affixed to the lower right hand portion of wall 19. Vane 22 is moved to completely open position by pivotally connected bar 32, in response to the opening movement of vane 23.**

When the vanes 22 and 23 are in open positions, transverse to the closed positions shown in FIG. 2, the bar 33 extends to greater length through slot 37. After the fire or smoke emergency is over, the damper may be returned to closed position to be held closed by magnet 50, by pushing bar 33 back into slot 37, to bring the left hand part of vane 32 back into proximity with magnet 50.

In all of the embodiments of the invention shown and described, vane stops 60 of L-shaped cross section may be provided as desired or required. In addition, seals (not shown) may be provided to seal around the vane edges as desired or required.

Referring to FIG. 4 of the drawings, there is shown a modified apparatus which is similar to the apparatus of FIGS. 1–3, but which is arranged so that vanes 22, 23 are normally held open. In FIG. 4, the magnet 50a carried by bracket 51*a* secured to wall 19 of the housing is positioned to attract and hold vane 22 in open position. The solenoid actuator 40a has its rod 45 positioned to push the upper part of vane 22 to the left, as shown in FIG. 4, when rod 45 is extended to position 45*a,* to move the vane out of influence of magnet 50*a.* The vane 22 then is moved to closed position by a suitable spring (not shown), vane 23 being also moved to closed position by bar 32, as was shown in FIG. 2.

The apparatus in FIGS. 5–7 is of modified form. FIG. 5 is a cross section taken from the reverse side of the apparatus, showing the underside of the cover and the elements within the housing. The cover 65 has louver openings 66 therethrough permitting air, smoke, or gas flow past the cover. Cover 65 has inturned edge flange 68 within which flange 69 around the sidewalls 71–74 of the housing is disposed. The flange 69 is secured to the edge portions of cover 65 by screws, rivets, or other suitable means, not shown. Vanes 77, 78 are mounted in the same manner as vanes 22, 23 of FIGS. 1–3, for pivotal movement between open and closed positions. Vanes 77, 78 are shown in open positions in FIG. 5, in closed positions in FIG. 6, and in open position by the solid line showing of FIG. 7. A fitting 80 for supporting the pivot rods of the vanes is provided at each end of each vane, connected to the appropriate walls 71, 73. Bracket 82 connected to vane 77 and bracket 83 connected to vane 78 have bar 74 pivotally connected therebetween at its ends, corresponding in function to bar 32 of FIG. 2. Bar 84 has its inner end pivotally connected to bracket 85, the bar extending through cover 65 through slot 86. Bar 84 corresponds in function to bar 33 of FIG. 2. When bar 84 is extended outwardly through slot 86, the vanes 77, 78 are in open position. When bar 83 is retracted inwardly with respect to slot 86, the vanes 77, 78 are in closed positions.

Referring especially to FIGS. 5 and 6, a support of L-shaped cross section formed by walls 90, 91 extends between walls 71, 73 across the upper portion of the housing interior, spaced from the louvers 66. The L-shaped support formed by walls 90, 91 is secured in place by angle brackets 94, 95, shown in FIG. 1. These are secured to wall 91 and walls 71, 73 by welding or brazing, or in other suitable manner, not shown. Wall 90 supports solenoid actuator 98 which has its axially movable rod or shaft 99 extending through a suitable opening through wall 91. When rod 99 is extended to position 99*a,* the upper part of vane 77 as shown in FIG. 6 is pushed away from wall 91.

There is no magnet to hold the vane 77 in closed or open position, as was the case in the embodiments of FIGS. 1–4. Instead, the vane is held in closed position by the action of a spring, to be later explained. Solenoid actuator 98 is energized and deenergized through electric cable 101.

Referring now especially to FIG. 7, and also to FIG. 5, a spring pivot housing 105 is secured at its flanges 106, 107 to the upper side of vane 78, as it is shown in open position by solid lines in FIG. 7. Vane 78 is cut away at the position of housing 105, and the mounting rod for vane 78 does not continue across the width of housing 105. Therefore housing 105 is completely open downwardly. A bracket 108 is secured to wall 74 at its rearward upper side. The lower end of helical tension spring 109 is connected to bracket 108. The upper end of spring 109 is connected to a cross pin 111 the ends of which are fixed to opposite walls of housing 105. Vane 78 pivotally moves between the solid line open position and the dashed line closed position, FIG. 7. The axis of this pivotal motion of the vane is indicated by cross 113. When vane 78 is in open position, the spring is to the left side of axis 113. When vane 78 is pivotally moved to closed position, pin 111 and the upper end of the spring are moved to the right past axis 113. Therefore, the vane is held in closed position by the spring in position 109a, because the spring acts downwardly to the right hand side of axis 113, but the same spring acts to hold the vane open against stop 114 affixed to wall 74, when the vane is pivoted by operation of actuator 98 so that the spring moves to the left of axis 113, as shown in FIG. 7. Spring 109 therefore replaces in function the function of the magnets 50, 50*a* of FIGS. 1–4. It will be readily understood, then, that the performance of the damper apparatus of FIGS. 5–7 is the same as for the other embodiments, but that the spring 109 supplants the magnets used in the other embodiments to hold the vanes in their normal positions.

As has been stated earlier, the damper apparatuses may be operated either by an electric current spllied to the actuators 40, 40a, and 98, or may be operated by shutting off of current to the actuators. In the latter case, the actuators would be normally electromagnetically retracted, and extension of the actuator rods by a spring would occur upon deenergization of the circuit. It will by now also be clear that the damper apparatuses may be made to be either normally closed or normally open, depending upon whether open flow therethrough or closing off of flow is desired under the particular circumstances.

While preferred embodiments of the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Damper apparatus, comprising a housing having a gas flow passage therethrough, two vanes movable between open and closed positions with respect to said gas flow passage, means for holding one of said vanes in one of said open and closed positions, means for biasing one of said vanes toward the other of said open and closed positions, and actuator means for moving the vane held thereby away from said holding means whereby said vane is released by said holding means so that said biasing means then moves the vane biased thereby toward said other of said open and closed positions, and means linking said two vanes together to move to said open and closed positions simultaneously.

2. The combination of claim 1, said actuator means being operated by an electrical signal.

3. The combination of claim 2, said electrical signal being produced by a detection device.

4. The combination of claim 3, said detection device producing said signal in response to the presence of fire, heat or smoke.

5. The combination of claim 1, said biasing means comprising spring means, said holding means comprising magnet means.

6. The combination of claim 5, said spring means comprising a helical tension spring.

7. Damper apparatus, comprising a housing having a gas flow passage therethrough, vane means movable between open and closed positions with respect to said gas flow passage, means for holding said vane means in one of said open and closed positions, means for biasing said vane means toward the other of said open and closed positions, and actuator means for moving said vane means away from said holding means whereby said vane means is released by said holding means so that said biasing means then moves said vane means toward said other of said open and closed positions, a single spring means providing both said holding means and said biasing means, said spring means being fixed in a stationary position at one of its ends and having a connection to said vane means at its other end, said vane means having an axis about which said vane means moves when said vane means is moved between its said open and closed positions, said spring means moving past said axis when said vane means is moved from one to the other of said open and closed positions, said spring means holding said vane means in one of said open and closed positions when on one side of said axis and biasing said vane means toward the other of said open and closed positions when on the other side of said axis.

8. The combination of claim 7, said spring means comprising a helical tension spring.

9. The combination of claim 8, said actuator means being operated by an electrical signal.

10. The combination of claim 9, said electrical signal being produced by a detection device.

11. The combination of claim 10, said detection device producing said signal in response to the presence of fire, heat or smoke.

12. Damper apparatus, comprising a housing having a spaced pair of parallel end walls and a spaced pair of parallel side walls connected together at their ends to form a flowway therethrough, a louvered cover connected around the edges of said walls at one side of said housing and the other side of said housing being open, a pair of vanes disposed parallely side by side between one said pair of walls equidistant from said cover, each said vane being pivotally movable about its longitudinal center between open and closed positions with respect to said flowway, link means connecting said vanes whereby said vanes are opened and closed simultaneously, means for holding said vanes in one of said open and closed positions when said vanes are moved into proximity of said holding means, biasing means for moving said vanes to the other of said open and closed positions when said vanes are moved out of proximity of said holding means, actuator means for moving said vanes out of proximity of said holding means in response to a signal to cause said biasing means to move said vanes to said other of said open and closed positions.

13. The combination of claim 12, said holding means comprising a magnet.

14. The combination of claim 12, said holding means comprising a spring having one end fixed to said housing and the other end fixed to one of said vanes to one side of said longitudinal center thereof, said vane in moving between said open and closed positions moving said other end of said spring across the position of said longitudinal center to act on said vane in the opposite direction of pivotal movement whereby said spring also serves as said biasing means.

15. The combination of claim 14, said spring comprising a helical tension spring.

16. The combination of claim 12, said signal being an electrical signal.

17. The combination of claim 16, said electrical signal being produced by a detection device.

18. The combination of claim 17, said detection device producing said signal in response to the presence of fire, heat or smoke.

* * * * *